US009935408B1

(12) United States Patent
Pathak et al.

(10) Patent No.: US 9,935,408 B1
(45) Date of Patent: Apr. 3, 2018

(54) ELECTRONIC CONNECTOR FOR CHARGING OR DATA TRANSFER

(71) Applicant: Verily Life Sciences LLC, Mountain View, CA (US)

(72) Inventors: Anupam J. Pathak, Mountain View, CA (US); Shannon C. Fong, San Francisco, CA (US); Dylan Owens, Sunnyvale, CA (US); John A. Redmond, San Francisco, CA (US)

(73) Assignee: Verily Life Sciences LLC, Mountain View, CA (US)

( * ) Notice: Subject to any disclaimer, the term of this patent is extended or adjusted under 35 U.S.C. 154(b) by 0 days.

(21) Appl. No.: 15/625,841

(22) Filed: Jun. 16, 2017

(51) Int. Cl.

| | |
|---|---|
| ***H01R 13/717*** | (2006.01) |
| ***H01R 31/06*** | (2006.01) |
| ***H01R 13/62*** | (2006.01) |
| ***H01R 13/66*** | (2006.01) |
| ***H01R 24/60*** | (2011.01) |
| ***H01R 24/20*** | (2011.01) |
| *H01R 107/00* | (2006.01) |
| *H01R 105/00* | (2006.01) |

(52) U.S. Cl.
CPC ..... *H01R 13/717* (2013.01); *H01R 13/6205* (2013.01); *H01R 13/665* (2013.01); *H01R 13/6616* (2013.01); *H01R 13/6683* (2013.01); *H01R 13/7172* (2013.01); *H01R 13/7175* (2013.01); *H01R 24/20* (2013.01); *H01R 24/60* (2013.01); *H01R 31/065* (2013.01); *H01R 2105/00* (2013.01); *H01R 2107/00* (2013.01)

(58) Field of Classification Search
CPC ..... H01R 13/7175; H01R 13/717
See application file for complete search history.

(56) References Cited

U.S. PATENT DOCUMENTS

| | | | | |
|---|---|---|---|---|
| 1,685,608 | A * | 9/1928 | Lipschutz | H01R 24/28 439/483 |
| 5,080,594 | A * | 1/1992 | Swinford | B60D 1/62 280/420 |
| 5,567,175 | A * | 10/1996 | Warden | H01R 13/717 264/272.11 |
| 5,751,135 | A * | 5/1998 | Fukushima | B60L 11/1818 320/107 |
| D416,233 | S | 11/1999 | Tsai | |
| 6,296,526 | B1 * | 10/2001 | Hussaini | H01R 24/58 439/668 |
| D468,265 | S * | 1/2003 | Cook | D13/144 |
| D484,137 | S | 12/2003 | Wikel et al. | |

(Continued)

OTHER PUBLICATIONS

Notice of Allowance for corresponding Design U.S. Appl. No. 29/594,593, dated Dec. 1, 2017, 7 pages.

*Primary Examiner* — James Harvey
(74) *Attorney, Agent, or Firm* — Christensen O'Connor Johnson Kindness PLLC

(57) ABSTRACT

An electronic connector includes a first connecting unit. The first connecting unit includes a housing having a ring hole disposed through the housing large enough for a finger to be inserted through the ring hole to grab the first connecting unit, a first electrical connector shaped for forming a first detachable electrical connection, the first electrical connector disposed at a first distal end of the first connecting unit, and an illuminator disposed within the housing proximate to the ring hole to illuminate an inside perimeter of the ring hole.

20 Claims, 4 Drawing Sheets

(56) References Cited

U.S. PATENT DOCUMENTS

| | | | | |
|---|---|---|---|---|
| 7,028,202 | B2 | 4/2006 | Long et al. | |
| 7,484,972 | B1 * | 2/2009 | Kuo | H01R 35/04 439/131 |
| 7,972,167 | B2 | 7/2011 | Amit et al. | |
| D709,504 | S | 7/2014 | Breines | |
| D727,907 | S | 4/2015 | Higashi | |
| D730,903 | S | 6/2015 | Langhammer et al. | |
| D733,142 | S | 6/2015 | Solomon et al. | |
| D736,151 | S | 8/2015 | Dentzel et al. | |
| D746,291 | S | 12/2015 | Solomon et al. | |
| D755,790 | S | 5/2016 | Salvatori et al. | |
| D756,817 | S | 5/2016 | Fries et al. | |
| D761,262 | S | 7/2016 | Solomon et al. | |
| D770,974 | S | 11/2016 | Dentzel et al. | |
| 9,515,420 | B2 | 12/2016 | Daoura | |
| D779,492 | S | 2/2017 | Lin | |
| D782,485 | S | 3/2017 | Cai | |
| D784,340 | S | 4/2017 | Laffon de Mazieres et al. | |
| 9,636,959 | B1 * | 5/2017 | Ihde | H01R 13/5845 |
| 2010/0070659 | A1 | 3/2010 | Ma et al. | |
| 2012/0081067 | A1 * | 4/2012 | Burrell, IV | H01R 13/7175 320/107 |
| 2014/0099808 | A1 * | 4/2014 | McClelland | H01R 13/6205 439/153 |
| 2014/0156879 | A1 * | 6/2014 | Wong | G06F 11/3027 710/19 |
| 2014/0187079 | A1 * | 7/2014 | Zien | H01R 13/514 439/490 |
| 2015/0171648 | A1 * | 6/2015 | Williams | H01R 13/7175 320/107 |

* cited by examiner

ELECTRONIC CONNECTOR FOR CHARGING OR DATA TRANSFER

TECHNICAL FIELD

This disclosure relates generally to electronic connectors, and in particular but not exclusively, relates to dongles.

BACKGROUND INFORMATION

Millions of individuals suffer from musculoskeletal or vision impairments that prevent fine motor control of the hands and fingers. Plugging in electronic connectors, such as universal serial bus (USB) connectors (including micro USB, USB-C, etc.), USB thumb drives, wall plugs, and the like, is difficult for many of this population. Interacting with electronic devices can be a daily struggle for such individuals. There is a need for electronic connectors that are easy to use for people with musculoskeletal and/or vision impairments.

BRIEF DESCRIPTION OF THE DRAWINGS

Non-limiting and non-exhaustive embodiments of the invention are described with reference to the following figures, wherein like reference numerals refer to like parts throughout the various views unless otherwise specified. Not all instances of an element are necessarily labeled so as not to clutter the drawings where appropriate. The drawings are not necessarily to scale, emphasis instead being placed upon illustrating the principles being described.

DETAILED DESCRIPTION

Embodiments of a system, apparatus, and method of operation of an electronic connector for charging or data transfer that is suitable for people suffering from impairments are described herein. In the following description numerous specific details are set forth to provide a thorough understanding of the embodiments. One skilled in the relevant art will recognize, however, that the techniques described herein can be practiced without one or more of the specific details, or with other methods, components, materials, etc. In other instances, well-known structures, materials, or operations are not shown or described in detail to avoid obscuring certain aspects.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Figure 1A:
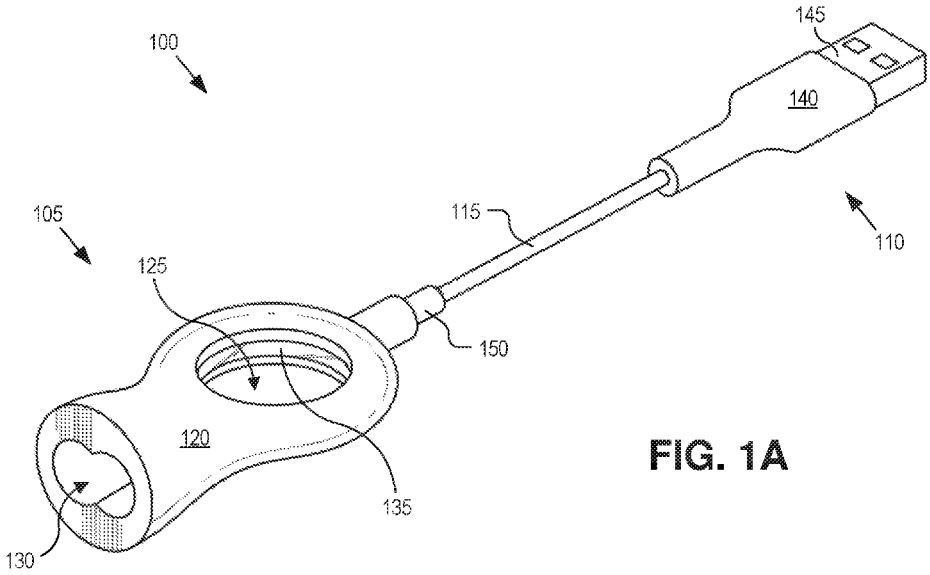
FIG. 1A is a perspective view illustration of an electronic connector that is suitable for people with various impairments to operate, in accordance with an embodiment of the disclosure.
Figure 1B:
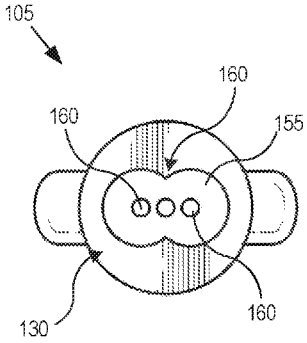
FIG. 1B is a distal end side view illustration of a first connecting unit of the electronic connector, in accordance with an embodiment of the disclosure.
Figure 1C:
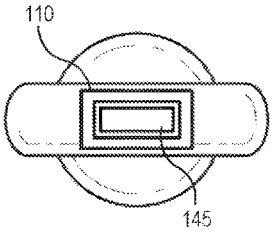
FIG. 1C is a distal end side view illustration of a second connecting unit of the electronic connector, in accordance with an embodiment of the disclosure.

FIGS. 1A-1C illustrate an electronic connector 100 for charging or data transfer that is suitable for use by people with disabilities, in accordance with an embodiment of the disclosure. The illustrated embodiment of electronic connector 100 includes a first connecting unit 105, a second connecting unit 110, and a cable 115 interconnecting the first and second connecting units. FIG. 1A is a perspective view illustration of electronic connector 100, FIG. 1B is side view illustration from the distal end of connecting unit 105, and FIG. 1C is a side view illustration from the distal end of connecting unit 110. Electronic connector 100 is a dongle that may be used for data transfers and/or charging. Electronic connector 100 may be used by those with disabilities that have difficulty plugging into USB memory drives, wall plugs, mobile devices (e.g., phones, laptops, tablets, etc), or other electronic devices.

The illustrated embodiment of first connecting unit 105 includes a housing 120 having a ring hole 125, an electrical connector 130, and an illuminator 135. The illustrated embodiment of second connecting unit 110 includes a housing 140 and an electrical connector 145. The illustrated embodiment of cable 115 includes a strain relief 150 and electrical conductors (internal to the cable—not illustrated) that electrically connect electrical connector 130 to electrical connector 145.

Housing 120 may be formed of plastic, rubberized plastic, or otherwise for housing the internal electronic components of first connecting unit 105. Ring hole 125 is disposed through housing 120 and is large enough for a finger to slide through the ring hole, grab first connecting unit 105, and manipulate first connecting unit 105. In particular, ring hole 125 is suitable as a grabbing and pulling location for connecting and disconnecting first connecting unit 105 to/from a mating device, such an adapter (e.g., adapter 300 illustrated in FIG. 3). Although FIG. 1A illustrates ring hole 125 as a circular hole, it should be appreciated that ring hole 125 may assume a variety of other inside perimeter shapes including an oval/ellipse, a rectangle or square, a rectangle/square with rounded corners, or other regular or irregular shapes so long as a the size of ring hole 125 is large enough for one or more fingers to slip into.

When electrical connector 145 is plugged into power (e.g., active USB port), in some embodiments, illuminator 135 lights up to provide a visible accent around the inside perimeter of ring hole 125. The illumination accent helps those with vision impairments see where to grab electronic connector 100. In some embodiments, illuminator 135 will adaptively change color, pulsation pattern, and/or blinking pattern to indicate a connection status or change in connection status. Example connection statuses include plugged in, charging, transferring data, error, etc.

In the illustrated embodiment, illuminator 135 is a light ring that encircles the inside perimeter of ring hole 125 to illuminate an entirety of the inside perimeter. In one embodiment, the light ring includes a translucent material inset into housing 120 and extending about the inside perimeter of ring hole 125. The translucent material forms a diffusive lighting window about ring hole 125. A plurality of light emitting diode (LEDs) may be disposed within housing 120 behind the translucent material as a sort of backlighting that encircles ring hole 125.

Referring to FIG. 1B, electrical connector 130 is a female connector that includes cavity receptacle 155 shaped to receive a male connector and also includes contacts 160 disposed in a bottom of cavity receptacle 155 for forming electrical connections. In one embodiment, contacts 160 are spring loaded pogo pins. In the illustrated embodiment, three contacts 160 are illustrated (e.g., positive, negative, ground); however, in other embodiments more or less contacts 160 may be implemented. For example, in one embodiment, four contacts 160 may be used including a power contact, a ground contact, a data contact, and an identifier contact. In an embodiment including an identifier contact, a resistive element is coupled to the identifier contact/pin. The resistive element has a resistance that is associated with a defined function of electronic connector 100. For example, the resistance value may indicate to a mating device that electronic connector 100 is a power adapter, a USB adapter, etc.

Cavity receptacle 155 has a cross-sectional shape to facilitate proper aligned between electrical connector 130 and the mating device. In the illustrated embodiment, cavity receptacle has a cross-sectional shape that is substantially equivalent to two intersecting ellipses (e.g., two intersecting circles). In one embodiment, the cross-sectional shape tapers (see FIG. 2B) having a smaller area proximate to the bottom of cavity receptacle 155 than towards its distal or outer end. The points of intersection 160 between the two intersecting ellipses may be sharp (illustrated) or rounded (not illustrated in FIG. 1B, though see FIG. 3 for mating adapter 300). Although FIG. 1B illustrates cavity receptacle 155 having a symmetrical cross-sectional shape that uses magnets (e.g., magnets 230 discussed in connection with FIGS. 2A and 2B) to prevent reversed connections, in other embodiments, cavity receptacle 155 may assume nonsymmetrical shapes that enforce non-reversibility. FIG. 4 illustrates demonstrative cross-sectional shapes for cavity receptacle 155. Cross-sectional shape 405 is two intersecting ellipses. Cross-sectional shape 410 is two intersecting ellipses with one of the intersection sides flattened. Cross-sectional shape 415 is a hybrid intersection of an ellipse and a rectangle where the intersection points of the rectangle are rounded. Of course, other symmetrical or non-symmetrical cross-sectional shapes may be implemented.

FIG. 1C is a side view illustration from the distal end of connecting unit 110. The illustrated embodiment of connecting unit 110 includes electronic connector 145 implemented as a male USB connector. However, in other embodiments, electronic connector 145 may be implemented by any variety of connectors, including standards based or proprietary connectors such as micro USB, USB-C, Lightning connector, or otherwise.

Figure 2A:
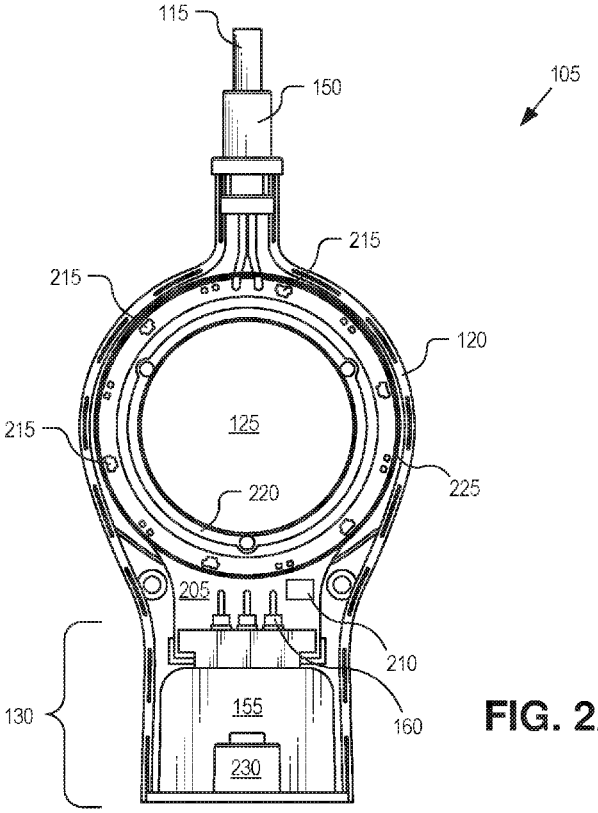
FIG. 2A is a plan view illustration of internal components of the first connecting unit, in accordance with an embodiment of the disclosure.
Figure 2B:
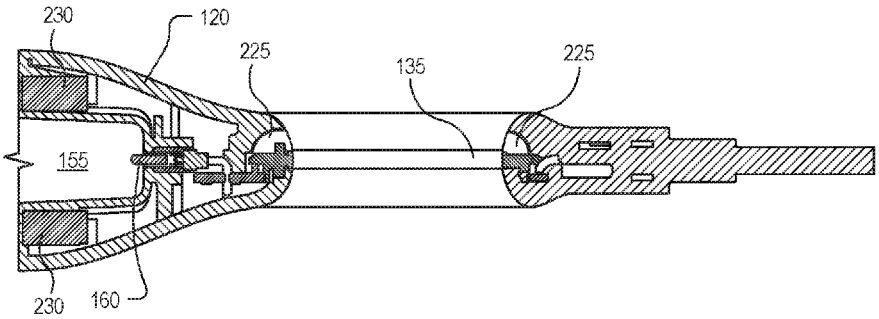
FIG. 2B is a cross-sectional illustration of internal components of the first connecting unit, in accordance with an embodiment of the disclosure.

FIG. 2A is a plan view illustration of internal components of first connecting unit 105, while FIG. 2B is a cross-sectional illustration of the internal components of first connecting unit 105, in accordance with an embodiment of the disclosure. The illustrated components of first connecting unit 105 include housing 120, electrical connector 130, a circuit board 205, a controller 210, LEDs 215, a diffusive lighting window 220, a shroud 225, magnets 230, and cavity receptacle 155.

As illustrated, illuminator 135 (also referred to as a light ring) includes diffusive lighting window 220, which is backlit by LEDs 215. LEDs 215 may all be the same monochrome color or include a plurality of different colored LEDs. Shroud 225 is disposed around LEDs 215 to reduce light leakage from LEDs 215 out of housing 120 in locations other than through the translucent material of diffusive lighting window 220. In one embodiment, shroud 225 is an opaque plastic or metallic ring. Of course, shroud 225 is optional, and may even be replaced with a thicker or more opaque housing 120, if reducing light leakage from LEDs 215 is desired. LEDs 215 are disposed around a ring section of circuit board 205. The ring section of circuit board 205 encircles ring hole 125 on the inside of housing 120 to provide a mounting surface for LEDs 215 and circuit trace connections to controller 210. Controller 210 is disposed on circuit board 205 and coupled to LEDs 215 to control their illumination. For example, controller 210 may drive LEDs 215 to indicate a connection status of electronic connector 100. In one embodiment, controller 210 monitors either electrical connector 130 and/or electrical connector 145 for a connection and adaptively drives LEDs 215 of the light ring to change one or more of a color, a pulsation pattern, or a blinking pattern to indicate the connection status. Controller 210 may be implemented as a microcontroller that executes logic instructions stored in an attached memory, an application specific integrated circuit, a field programmable gate array, or otherwise.

In the illustrated embodiment, magnets 230 are disposed on opposing sides of cavity receptacle 155 within housing 120. The two magnets 230 provide a positive force for holding a mating male connector within cavity receptacle 155 and maintaining the electrical connection against contacts 160 (e.g., pogo pins). In one embodiment, the two magnets 230 have a magnetic orientation, relative to magnets in a mating male connector, that resists inserting the male connector into cavity receptacle 155 in a reverse orientation. This ensures correct pin-contact lineup. The magnets also serve to aid a user with limited dexterity to lineup a mating connector with cavity receptacle 155.

Figure 3:
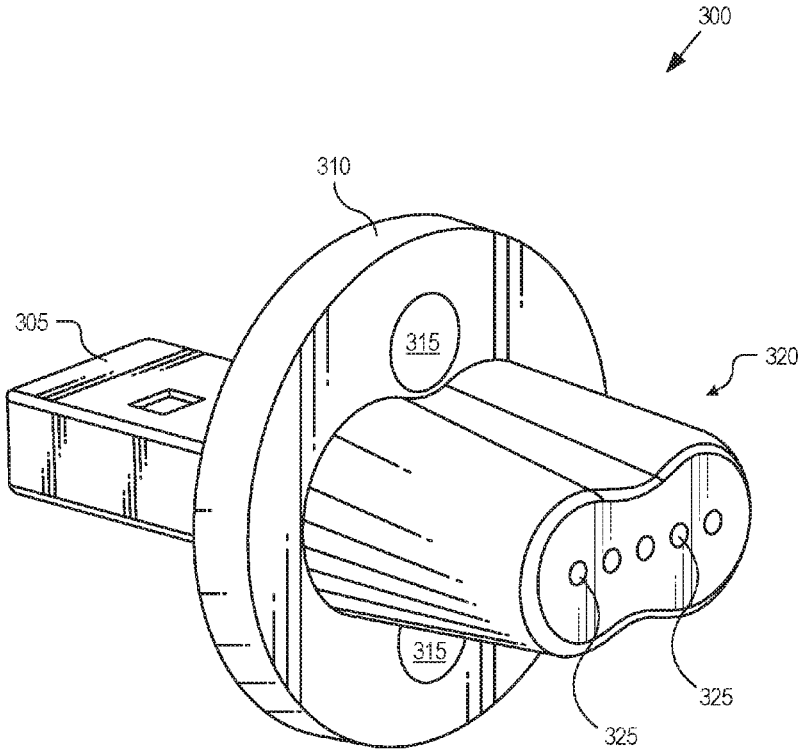
FIG. 3 is a perspective view illustration of an adapter for use with the electronic connector, in accordance with an embodiment of the disclosure.
Figure 4:
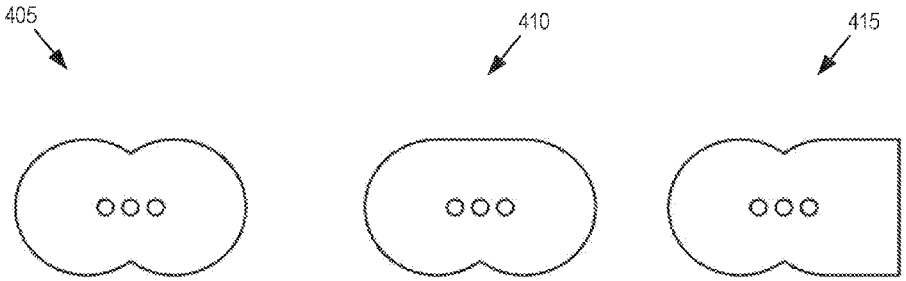
FIG. 4 illustrates example cross-sectional shapes for a cavity receptacle, in accordance with embodiments of the disclosure.

FIG. 3 is a perspective view illustration of an adapter 300 for use with electronic connector 100, in accordance with an embodiment of the disclosure. The illustrated embodiment of adapter 300 is a stubby connector that adapts a female port (e.g., a USB port on a computer) to a male connector that mates to electrical connector 130 of electronic connector 100. Thus, in one embodiment, adapter 300 serves to convert hard to align and use ports on a computer to a form factor that will mate to the dongle apparatus of electronic connector 100. In other words, adapter 300 simplifies the use of ports on a computer making them accessible to users with musculoskeletal or vision impairments. The illustrated embodiment of adapter 300 includes a first male electrical connector 305, a flange 310, magnets 315, and a second male electrical connector 320 including contacts 325.

In the illustrated embodiment, first male electrical connector 305 is illustrated as a USB connector for plugging into a standard USB port on a computer. However, it is anticipated that male electrical connector 305 may assume any variety of form factors for adapting to a variety of existing ports available today. First male electrical connector 305 includes contacts (not illustrated) that are electrically connected or hardwired to contacts 325. Although FIG. 3 illustrates five contacts 325 disposed along the distal end of second male electrical connector 320, more or less contacts 325, arranged in a line or another pattern, may be included dependent upon the particular application.

The shape of second male electrical connector 320 is shaped to mate with (or be received by) cavity receptacle 155, illustrated in FIGS. 1B, 2A, and 2B. For example, the illustrated embodiment of male electrical connector 320 has a cross-sectional shape that is substantially equivalent to two intersecting ellipses and tapers having a smaller area near its distal end relative to its base proximate to flange 310. Furthermore, in the illustrated embodiment, the points of intersection between the two intersecting elliptical shapes are rounded to further easy alignment with cavity receptacle 155.

Upon mating with cavity receptacle 155, contacts 325 form electrical connections with contacts 160 (e.g., pogo pins) disposed in a bottom of cavity receptacle 155. Furthermore, magnets 315 disposed in flange 310 are positioned, and magnetically polarized (oriented), to aligned with and attract magnets 230 disposed in first connecting unit 105. In fact, magnets 315 and 230 provide the positive attractive force that ensures electrical connection between contacts 325 and 160. Furthermore, the orientation of magnets 315 and 230 are selected to resist or repel a reverse orientated connection between male electrical connector 320 and the female electrical connector 130 of the dongle.

The processes explained above are described in terms of computer software and hardware. The techniques described may constitute machine-executable instructions embodied within a tangible or non-transitory machine (e.g., computer) readable storage medium, that when executed by a machine will cause the machine to perform the operations described. Additionally, the processes may be embodied within hardware, such as an application specific integrated circuit ("ASIC") or otherwise.

A tangible machine-readable storage medium includes any mechanism that provides (i.e., stores) information in a non-transitory form accessible by a machine (e.g., a computer, network device, personal digital assistant, manufacturing tool, any device with a set of one or more processors, etc.). For example, a machine-readable storage medium includes recordable/non-recordable media (e.g., read only memory (ROM), random access memory (RAM), magnetic disk storage media, optical storage media, flash memory devices, etc.).

The above description of illustrated embodiments of the invention, including what is described in the Abstract, is not intended to be exhaustive or to limit the invention to the precise forms disclosed. While specific embodiments of, and examples for, the invention are described herein for illustrative purposes, various modifications are possible within the scope of the invention, as those skilled in the relevant art will recognize.

These modifications can be made to the invention in light of the above detailed description. The terms used in the following claims should not be construed to limit the invention to the specific embodiments disclosed in the specification. Rather, the scope of the invention is to be determined entirely by the following claims, which are to be construed in accordance with established doctrines of claim interpretation.

What is claimed is:

1. An electronic connector, comprising:

a first connecting unit including:

a housing having a ring hole disposed through the housing large enough for a finger to be inserted through the ring hole to grab the first connecting unit;

a first electrical connector shaped for forming a first detachable electrical connection, the first electrical connector disposed at a first distal end of the first connecting unit; and an illuminator disposed within the housing proximate to the ring hole to illuminate an inside perimeter of the ring hole; and a second connecting unit having a second electrical connector, different than the first electrical connector, wherein the second electrical connector is electrically coupled to the first electrical connector.

2. The electronic connector of claim 1, wherein the electronic connector is a dongle and the electronic connector further includes:

a cable extending between proximate ends of the first and second connecting units, wherein the cable electrically connects the first electrical connector to the second electrical connector.

3. The electronic connector of claim 1, wherein the illuminator comprises a light ring that encircles the inside perimeter of the ring hole to illuminate an entirety of the inside perimeter.

4. The electronic connector of claim 3, wherein the light ring comprises:

a translucent material inset into the housing and extending about the inside perimeter of the ring hole, the translucent material forming a diffusive lighting window about the ring hole; and a plurality of light emitting diodes (LEDs) disposed within the housing behind the translucent material and encircling the ring hole.

5. The electronic connector of claim 4, wherein the LEDs including a plurality of different colored LEDs.

6. The electronic connector of claim 4, wherein the light ring further comprising:

a shroud disposed around the LEDs to reduce light leakage from the LEDs out of the housing other than through the translucent material, wherein the LEDs are disposed between the shroud and the translucent material.

7. The electronic connector of claim 4, wherein the first connecting unit further includes:

a circuit board disposed within the housing, wherein the circuit board includes a ring section that encircles the ring hole inside the housing and upon which the LEDs are mounted; and a controller disposed on the circuit board and coupled to the LEDs to illuminate the LEDs to visually indicate a connection status of the electronic connector.

8. The electronic connector of claim 7, wherein the controller includes logic that when executed by the controller causes the electronic connector to perform operations including:

monitoring for a connection with the electronic connector; and adaptively driving the light ring to change at least one of a color, a pulsation pattern, or a blinking pattern of the light ring to indicate the connection status.

9. The electronic connector of claim 1, wherein the first electrical connector is a female connector comprising:

a cavity receptacle shaped to receive a male connector; and a plurality of pogo pins disposed in a bottom of the cavity receptacle for forming electrical connections.

10. The electronic connector of claim 9, wherein the first electrical connector further comprises:

two magnets each disposed on opposing sides of the cavity receptacle within the housing, wherein the two magnets provide a positive force for holding the male connector within the cavity receptacle and maintaining the electrical connections against the pogo pins, wherein the two magnets have a magnetic orientation that resists inserting the male connector into the cavity receptacle in a reverse orientation.

11. The electronic connector of claim 9, wherein one of the pogo pins comprises an identifier pin and wherein the first connecting unit further includes:

a resistive element coupled to the identifier pin, wherein the resistive element has a resistance that is associated with a function of the electronic connector.

12. The electronic connector of claim 9, wherein the cavity receptacle has a cross-sectional shape that is substantially equivalent to two intersecting ellipses.

13. The electronic connector of claim 12, wherein points of intersection between the two intersecting ellipses are rounded and wherein the cross-sectional shape tapers having a smaller area proximate to the bottom of the cavity receptacle.

14. The electronic connector of claim 1, wherein the second electrical connector comprises a male universal serial bus (USB) connector.

15. An electronic connecting system, comprising:

an adapter that adapts a female port to a male connector; and a dongle that mates to the adapter, the dongle including:

a housing having a ring hole disposed through the housing large enough for a finger to be inserted through the ring hole to grab the dongle;

a first electrical connector shaped for forming a first detachable electrical connection to the male connector of the adapter, the first electrical connector disposed at a first distal end of the dongle; and an illuminator disposed within the housing proximate to the ring hole to illuminate an inside perimeter of the ring hole.

16. The electronic connecting system of claim 15, wherein the illuminator comprises a light ring that encircles the inside perimeter of the ring hole to illuminate the inside perimeter, wherein the light ring comprises:

a translucent material inset into the housing and extending about the inside perimeter of the ring hole, the translucent material forming a diffusive lighting window about the ring hole; and a plurality of light emitting diodes ("LEDs") disposed within the housing behind the translucent material and encircling the ring hole.

17. The electronic connecting system of claim 16, wherein the light ring further comprising:

a shroud disposed around the LEDs to reduce light leakage from the LEDs out of the housing other than through the translucent material, wherein the LEDs are disposed between the shroud and the translucent material.

18. The electronic connecting system of claim 16, wherein the dongle further includes:

a circuit board disposed within the housing, wherein the circuit board includes a ring section that encircles the ring hole inside the housing and upon which the LEDs are mounted; and a controller disposed on the circuit board and coupled to the LEDs to illuminate the LEDs to visually indicate a connection status of the electronic connector.

19. The electronic connecting system of claim 15, wherein the adapter includes a plurality of contacts disposed along a distal end of the male connector and wherein the first electrical connector is a female connector comprising:

a cavity receptacle shaped to receive the male connector; and a plurality of pogo pins disposed in a bottom of the cavity receptacle for forming electrical connections to the plurality of contacts disposed along the distal end of the male connector.

20. The electronic connector of claim 19, wherein the adapter further includes a flange disposed at a base of the male connector and two magnets disposed within the flange, wherein the first electrical connector further comprises:

two additional magnets each disposed on opposing sides of the cavity receptacle within the housing, wherein the two additional magnets provide a positive force for holding the male connector of the adapter within the cavity receptacle of the dongle and maintaining the electrical connections between the pogo pins and the contacts, wherein the two additional magnets have a magnetic orientation relative to the two magnets within the flange of the adapter that resists inserting the male connector into the cavity receptacle in a reverse orientation.

* * * * *